US007719191B2

(12) United States Patent
Nishimura et al.

(10) Patent No.: US 7,719,191 B2
(45) Date of Patent: May 18, 2010

(54) PLASMA DISPLAY PANEL

(75) Inventors: Masaki Nishimura, Osaka (JP); Masaki Nishinaka, Osaka (JP); Akinobu Miyazaki, Osaka (JP)

(73) Assignee: Panasonic Corporation, Osaka (JP)

( * ) Notice: Subject to any disclaimer, the term of this patent is extended or adjusted under 35 U.S.C. 154(b) by 357 days.

(21) Appl. No.: 11/883,928

(22) PCT Filed: Mar. 30, 2007

(86) PCT No.: PCT/JP2007/057037

§ 371 (c)(1),
(2), (4) Date: Aug. 8, 2007

(87) PCT Pub. No.: WO2007/114320

PCT Pub. Date: Oct. 11, 2007

(65) Prior Publication Data

US 2008/0284333 A1 Nov. 20, 2008

(30) Foreign Application Priority Data

Mar. 31, 2006 (JP) ..... 2006-098874

(51) Int. Cl.
*H01J 17/49* (2006.01)

(52) U.S. Cl. ..... 313/582; 313/512

(58) Field of Classification Search ..... 313/582, 313/512

See application file for complete search history.

(56) References Cited

U.S. PATENT DOCUMENTS

| | | | | |
|---|---|---|---|---|
| 5,909,083 | A * | 6/1999 | Asano et al. | 313/584 |
| 7,030,560 | B2 * | 4/2006 | Ko et al. | 313/582 |
| 2004/0056597 | A1 * | 3/2004 | Ko et al. | 313/582 |
| 2008/0284334 | A1 * | 11/2008 | Oh et al. | 313/586 |
| 2009/0230861 | A1 * | 9/2009 | Miyazaki et al. | 313/582 |

FOREIGN PATENT DOCUMENTS

| | | | |
|---|---|---|---|
| JP | 2003-197110 | | 7/2003 |
| JP | 2003297253 | A * | 10/2003 |
| JP | 2004-139921 | | 5/2004 |
| JP | 2005-347057 | | 12/2005 |

* cited by examiner

*Primary Examiner*—Peter Macchiarolo
(74) *Attorney, Agent, or Firm*—Wenderoth, Lind & Ponack, L.L.P.

(57) ABSTRACT

A plasma display panel has an image display region(17)and a non-image display region formed by facing front glass substrate (3) to back glass substrate (10), and has a sealed part (18) formed by sealing peripheries of the glass substrates in the non-image display region with a seal layer(19). A thickness of at least one of the front glass substrate (3) and the back glass substrate (10) is 2.0 mm or less, and an interval between the glass substrates in the sealed part longer than an interval between the glass substrates in the image display region.

3 Claims, 6 Drawing Sheets

PLASMA DISPLAY PANEL

BACKGROUND OF THE INVENTION

1. Field of Invention

The present invention relates to a plasma display panel that employs light emission by gas discharge.

2. Description of the Related Art

A plasma display panel (hereinafter referred to as "PDP") has a structure where a front plate and a back plate are disposed to face each other and the peripheral parts of the plates are sealed with a sealing member. The discharge space formed between the front plate and the back plate is filled with discharge gas such as neon (Ne) and xenon (Xe).

The front plate has the following elements:

a plurality of display electrodes that are disposed on a glass substrate and include stripe-like scan electrodes and sustain electrodes;

a dielectric layer for covering the display electrodes; and a protective layer for covering the dielectric layer.

Each display electrode is formed of a transparent electrode and a metal-made bus electrode disposed on the transparent electrode.

The back plate has the following elements:

a plurality of stripe-like address electrodes disposed on a glass substrate;

a dielectric layer for covering the address electrodes;

barrier ribs that are disposed on the dielectric layer and partition the discharge space; and phosphor layers that are disposed on the dielectric layer between the barrier ribs and on side surfaces of the barrier ribs and emit red light, green light, and blue light.

The front plate and back plate are disposed to face each other so that the display electrodes and the address electrodes intersect, and discharge cells are formed in the intersecting parts of the electrodes.

The discharge cells are arranged in a matrix shape. Three discharge cells having phosphor layers for emitting red light, green light, and blue light are arranged in the display electrode direction, and form a pixel for color display.

The PDP displays a color image in the following processes:

a predetermined voltage is applied between scan electrodes and address electrodes and between the scan electrodes and sustain electrodes to cause gas discharge; and the phosphor layers are excited by ultraviolet rays generated by the gas discharge to emit light.

Generally, the pressure of the discharge gas filled into the PDP is about 66.7 kPa (500 Torr) and is lower than the atmospheric pressure, so that pressing force acts in the direction where the front plate and back plate are mutually pressed while the barrier ribs are sandwiched between them. In a place having low atmospheric pressure, however, the pressing force becomes weak, the PDP deforms in the swelling direction, and the pressing force acting between the front plate and back plate is reduced. As a result, when a voltage pulse is applied to the address electrodes and display electrodes in lighting the PDP, the collision between the dielectric layer and barrier ribs is repeated by vibration due to a piezoelectric effect of the dielectric layer, and noise whose frequency is within an audible region of about 10 kHz occurs.

For addressing such a problem, an example is disclosed where the thickness of a sealed part in sealing the peripheral part is made greater than the interval size in an image display region and the central part of the image display region is recessed (e.g. patent document 1).

When the thickness of the sealed part is made greater than the interval in the image display region, however, a "gap" occurs between the tops of the barrier ribs and the dielectric layer especially in the peripheral part of the image display region, thereby generating crosstalk. The crosstalk is a phenomenon where a discharge cell adjacent to a discharge cell in discharge hardly lights up. This crosstalk occurs because material called priming particles (charged particles) generated by discharge comes to the adjacent discharge cell through the "gap" and hence the discharge of the discharge cell hardly occurs. Therefore, the crosstalk causes a lighting failure, and voltage applied to address electrodes or the like is required to be increased for preventing the crosstalk, disadvantageously.

[Patent document 1] Japanese Patent Unexamined Publication No. 2004-139921

BRIEF SUMMARY OF THE INVENTION

The present invention provides a PDP that has an image display region and a non-image display region formed by facing a pair of glass substrates to each other and has a sealed part formed by sealing the peripheries of the glass substrates in the non-image display region with a seal layer. The thickness of at least one of the glass substrates is 2 mm or less, and an interval between the glass substrates in the sealed part is longer than an interval between the glass substrates in the image display region.

Such a structure can achieve a PDP where noise is suppressed without damaging the uniformity of the strength of the PDP, and where crosstalk or the like does not occur.

DETAILED DESCRIPTION OF THE INVENTION

First Exemplary Embodiment

Figure 1:
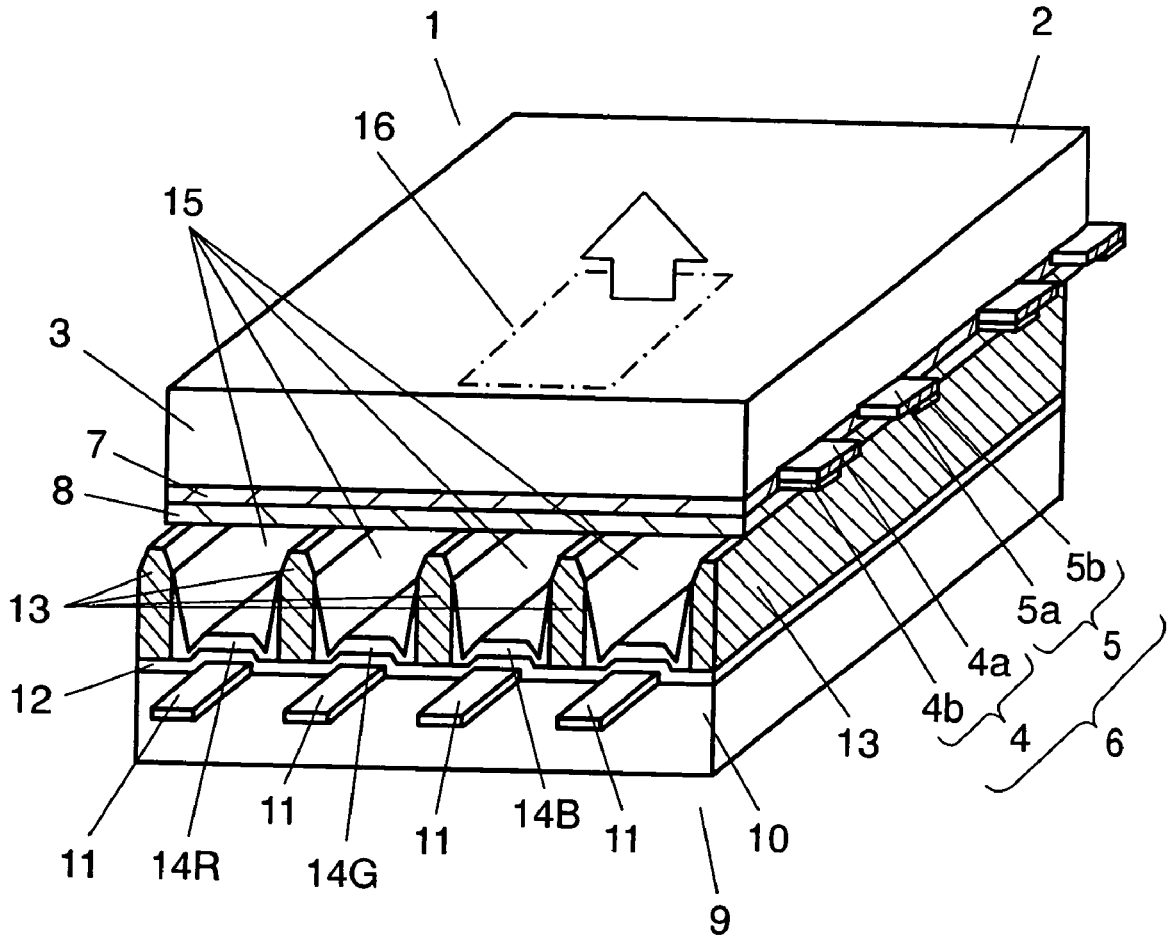
FIG. 1 is a perspective view showing a structure of a PDP in accordance with an exemplary embodiment of the present invention.

FIG. 1 is a sectional perspective view showing a structure of a PDP in accordance with an exemplary embodiment of the present invention. Front plate 2 of PDP 1 has a plurality of display electrodes 6 formed of scan electrodes 4 and sustain electrodes 5. Display electrodes 6 are formed on insulating front glass substrate 3 formed of a glass substrate that has a thickness from 0.5 mm to 2.0 mm and is made of float glass of a high strain point. Dielectric layer 7 is formed so as to cover display electrodes 6, and protective layer 8 made from MgO is formed on dielectric layer 7. Scan electrode 4 and sustain electrode 5 are formed of transparent electrodes 4*a* and 5*a* serving as discharge electrodes, and bus electrodes 4*b* and 5*b* that are electrically coupled to transparent electrodes 4*a* and 5*a* and made of Cr/Cu/Cr or Ag.

Back plate 9 has a plurality of address electrodes 11 on insulating back glass substrate 10 that is formed of a glass substrate or the like having a thickness from 0.5 mm to 2.0 mm, similarly to the front plate. Base dielectric layer 12 is formed so as to cover address electrodes 11. Barrier ribs 13 are disposed at positions between address electrodes 11 on base dielectric layer 12, phosphor layers 14R, 14G and 14B emitting red light, green light and blue light are disposed on the surface of base dielectric layer 12 and side faces of barrier ribs 13.

Front plate 2 and back plate 9 are disposed to face each other with barrier ribs 13 sandwiched between them so that display electrodes 6 and address electrodes 11 intersect and discharge spaces 15 are formed. Discharge spaces 15 are filled with at least one kind of rare gas, such as helium, neon, argon, xenon. Discharge spaces 15 in the intersecting parts between address electrodes 11 and scan electrodes 4 and between address electrodes 11 and sustain electrodes 5 are partitioned by barrier ribs 13, and work as discharge cells 16.

In other words, discharge is caused in a specific discharge cell 16 by applying voltage to address electrodes 11 and display electrodes 6, and ultraviolet rays generated by the discharge are radiated to phosphor layers 14R, 14G and 14B and are converted into visible light, thereby displaying an image in the arrow direction.

Figure 2:
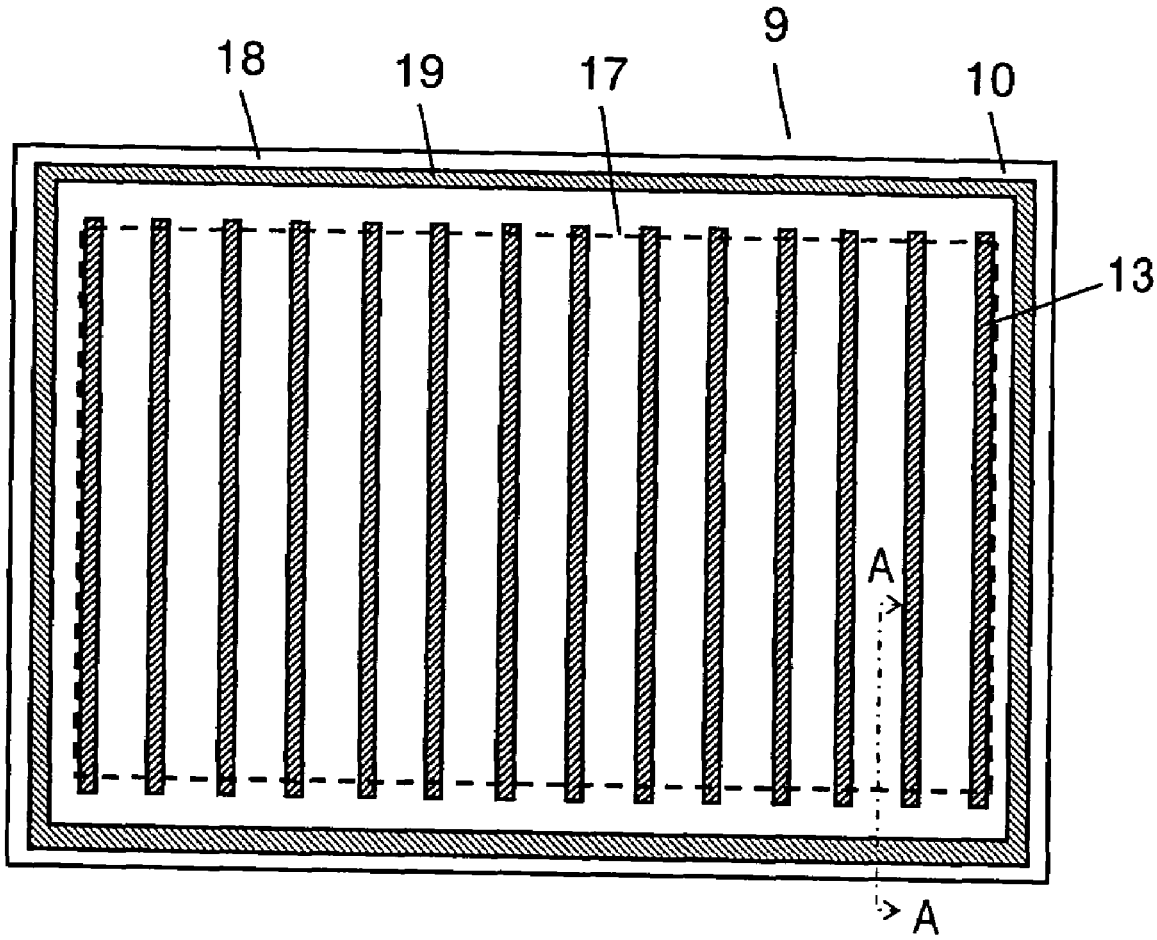
FIG. 2 is a plan view showing a structure of a back plate and a structure of a sealed part of the PDP in accordance with the exemplary embodiment.

FIG. 2 is a plan view showing a structure of back plate 9 and a structure of the sealed part of PDP 1 in accordance with the exemplary embodiment of the present invention. In PDP 1, front plate 2 (not shown) is bonded to back plate 9 in seal layer 19. Here, seal layer 19 is disposed in sealed part 18 outside image display region 17 that is represented as a region surrounded by the dotted line in FIG. 2.

Figure 3A:
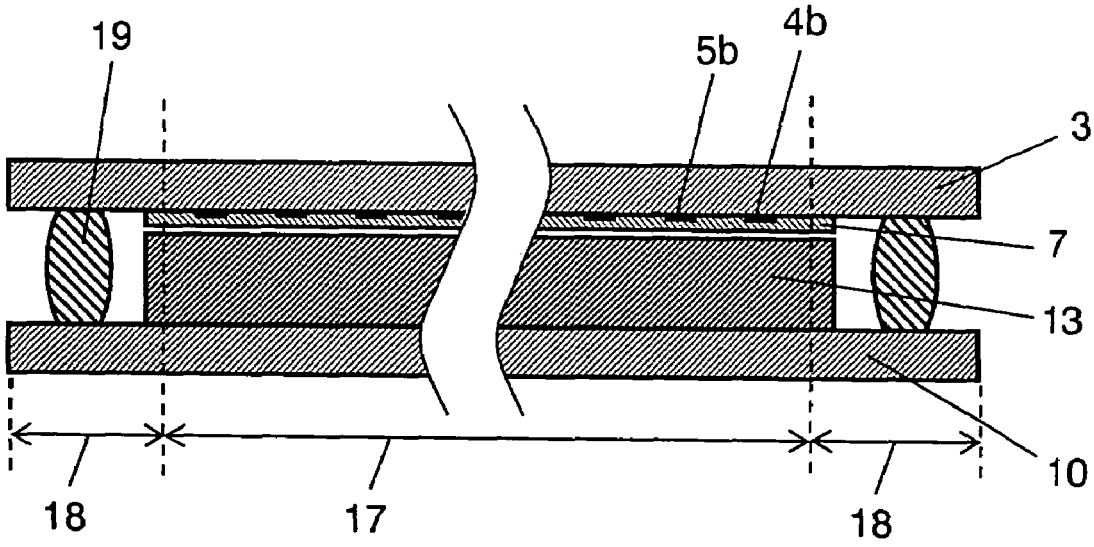
FIG. 3A is a sectional view showing an essential part of the PDP in accordance with the exemplary embodiment.

FIG. 3A is a sectional view showing an essential part of the PDP in accordance with the exemplary embodiment of the present invention, and the sectional view is taken in the narrow side direction of PDP 1 shown in FIG. 2. As shown in FIG. 2, the sealing is performed so that the surface of dielectric layer 7 formed on front plate 2 is parallel to the tops of barrier ribs 13 formed on back plate 9.

This step (hereinafter referred to as "sealing step") is hereinafter described in detail. As seal layer 19 in sealed part 18 of at least one of front plate 2 and back plate 9, paste containing seal material made of low-melting glass material is applied. Then, front plate 2 and back plate 9 are aligned, and heated while being fixed by a pressing force by a clip. The temperature at this time is called sealing temperature. When the seal material is heated to the sealing temperature, it melts. Front plate 2 and back plate 9 are sealed in seal layer 19 by melting the seal material, and the sealing step is finished.

Then, discharge spaces 15 are heated and evacuated (exhaustion and baking) to high vacuum, and then discharge gas is filled at a predetermined pressure, thereby completing PDP 1.

In the sealing step, the seal material of seal layer 19 is temporarily melted by heating. At this time, the thickness of seal layer 19 of PDP 1 can be varied by the following phenomenon:

variation of the action state of the pressing force is caused by the variation of the relative position of the clip to barrier ribs 13; or the seal material itself of seal layer 19 contracts.

Figure 3B:
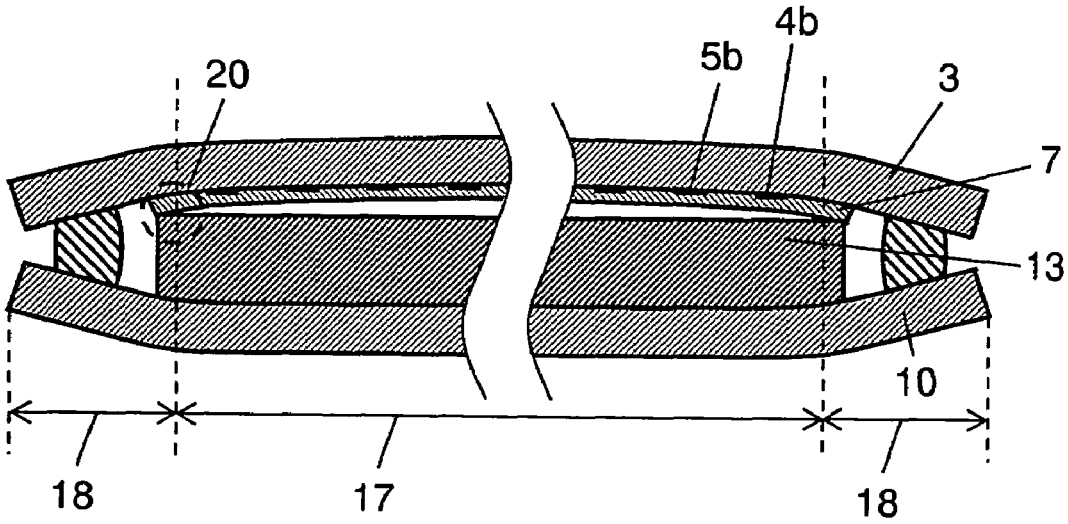
FIG. 3B is a sectional view showing an essential part of the PDP when a seal layer of the sealed part is contracted and sealed.

FIG. 3B is a sectional view in the narrow side direction of PDP 1 showing an essential part of PDP 1 when seal layer 19 of sealed part 18 is contracted and sealed. In PDP 1 in this case, the distance between front plate 2 and back plate 9 decreases in sealed part 18 and the periphery of image display region 17, and the central part swells. At this time, dielectric layer 7 of front plate 2 or protective layer 8 (not shown) and barrier ribs 13 have contact part 20 in a boundary part between image display region 17 and sealed part 18.

In PDP 1 having such a shape, noise occurs when an alternating current (AC) voltage pulse is applied to address electrodes 11 and display electrodes 6. This noise is considered to be created by the repetition of the collision between dielectric layer 7 and barrier ribs 13 near contact part 20. This repetition is caused by the vibration due to a piezoelectric effect of dielectric layer 7 or base dielectric layer 12. The frequency of the noise is about 10 kHz, and people can recognize the noise sufficiently.

Generally, the pressure of the discharge gas to be filled into PDP 1 is about 66.7 kPa (500Torr), and is set lower than the atmospheric pressure. Therefore, pressing force acts in the direction where front plate 2 and back plate 9 are pressed with barrier ribs 13 sandwiched between them, so that the occurrence of the noise is suppressed. In a place having low atmospheric pressure, however, the pressing force becomes weak, PDP 1 deforms in the swelling direction, and the pressing force acting between front plate 2 and back plate 9 is reduced. As a result, noise is apt to occur. In other words, in place having low atmospheric pressure, the problem about noise arises more remarkably.

For addressing the problem, an example is disclosed where the thickness of sealed part 18 in sealing the periphery is made greater than the interval size of image display region 17 and the central part of image display region 17 is recessed.

When the height of seal layer 19 is increased, however, gap occurs between the tops of barrier ribs 13 and dielectric layer 7 in the peripheral part of image display region 17. This gap causes crosstalk or a lighting failure, or requires an undesired increase in address voltage.

An example of producing front plate 2 of PDP 1 of the exemplary embodiment of the present invention is described with reference to FIG. 1. As front glass substrate 3, a 42-inch glass substrate formed of three kinds of insulating glass with thicknesses of 1.2 mm, 1.8 mm and 2.8 mm is used. Transparent electrodes 4*a* and 5*a* primarily made of indium tin oxide (ITO) are formed in a predetermined pattern on front glass substrate 3. Then, a plurality of silver pastes produced by mixing silver powder and organic vehicles are applied in line shapes, and the glass substrate is then fired to form bus electrodes 4*b* and 5*b*. Glass paste for dielectric produced by mixing dielectric glass powder and organic vehicles is applied to display electrodes 6, dried and fired by a blade coater method, thereby forming dielectric layer 7. Magnesium oxide (MgO) is applied to dielectric layer 7 by an electron-beam evaporation method and fired, thereby forming protective layer 8 to produce front plate 2.

An example of producing back plate 9 is hereinafter described with reference to FIG. 1. As back glass substrate 10, a 42-inch glass substrate formed of three kinds of insulating glass with thicknesses of 1.2 mm, 1.8 mm and 2.8 mm is used. Stripe-like address electrodes 11 primarily made of silver are formed on back glass substrate 10 by screen printing. Then, base dielectric layer 12 is formed by a method similar to that of front plate 2. Then, glass paste for barrier ribs is repeatedly applied between adjacent address electrodes by the screen printing method and then fired, thereby forming barrier ribs 13. Finally, red phosphor layer 14R, green phosphor layer 14G, and blue phosphor layer 14B are formed on the wall surfaces of barrier ribs 13 and the surface of base dielectric layer 12 that is exposed between barrier ribs 13 by the screen printing method, thereby producing back plate 9.

One of produced front plate 2 and back plate 9 is coated with the seal material paste using a dispenser. After coating, the paste is temporarily fired at 410° C. Then, front plate 2 is overlaid on back plate 9, and they are fired at 470° C. for 20 minutes to be sealed. The discharge spaces are evacuated at 400° C. to high vacuum (about $1\times10^{-4}$ Pa), and Ne—Xe base discharge gas is filled at a predetermined pressure, thereby producing PDP 1.

Gap width measurement, noise evaluation, crosstalk evaluation, peripheral strain measurement of the sealed part of PDP 1 produced in this manner are performed.

Figure 4:
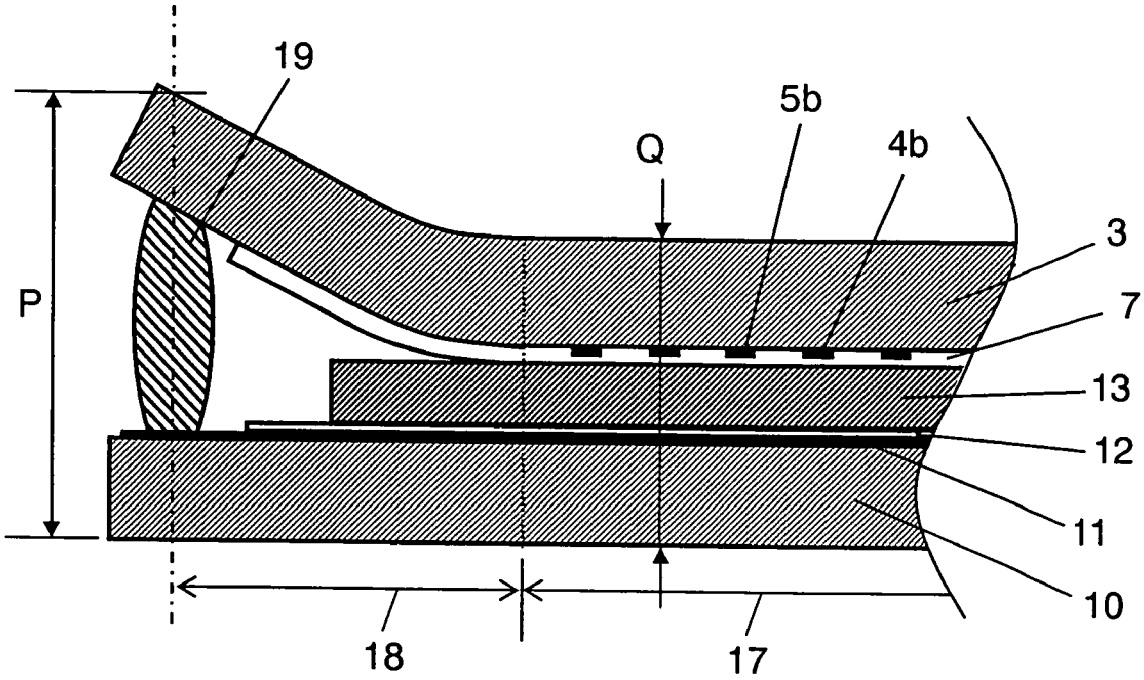
FIG. 4 is a sectional view taken from line A-A of FIG. 2.

The gap width measurement of the sealed part is described using FIG. 4. FIG. 4 is a sectional view taken in the line A-A of FIG. 2. Thickness P of a substantially central part of seal layer 19 in PDP 1 is measured by a micrometer. Thickness Q of image display region 17 in PDP 1 is then measured by the micrometer. The gap width of the sealed part is obtained by subtracting thickness Q from thickness P. When the gap width is positive, it is indicated that image display region 17 in PDP 1 is more recessed than sealed part 18. When the gap width is negative, it is indicated that image display region 17 in PDP 1 is more projected than sealed part 18.

Next, the noise evaluation is described. In this noise evaluation, PDP 1 is lighted, a microphone is installed at a point separated by 5 cm in the normal direction from the display surface of PDP 1, and noise is measured at five points in the surface at a measurement frequency of 12.5 kHz. The noise is created by contact between barrier ribs 13 and front plate 2 as discussed above. Thus, when the pressing force in the direction of pressing front plate 2 and back plate 9 with barrier ribs 13 sandwiched between them is reduced, the noise is apt to increase. In other words, the noise is apt to occur as the ambient pressure of the panel decreases. Thus, the noise evaluation is performed at 520 Torr, namely ambient pressure that is set in consideration of 3000 m of altitude above sea level, and noise of 30 dB or lower is set acceptable.

Next, the crosstalk evaluation is described. Crosstalk is a phenomenon caused by the "gap" as discussed above, and can be eliminated by increasing the voltage applied to address electrodes 11. However, increasing the voltage increases the cost of a circuit or the like. When the increment of the voltage applied to address electrodes 11 is 5V or lower, the cost increase is small. Therefore, this increment is set acceptable.

Next, the peripheral strain measurement is described. The peripheral strain means the strain of the glass in sealed part 18 caused by sealing, the strength reduces with increase in peripheral strain. The peripheral strain measurement is performed as follows. In image display region 17 and sealed part 18, breaking height is measured from which a hard ball made of stainless steel with a diameter of 10 mm is dropped to break the substrate. Strain in sealed part 18 is larger than that in image display region 17, so that the breaking height is low. When the breaking height in sealed part 18 is not lower than 80% of that in image display region 17, this breaking height has no problem from a practical viewpoint and hence is set acceptable.

Table 1 shows a measuring result by these evaluation methods of PDP 1 where the thickness of the glass substrate is varied and the gap width of the sealed part is varied. The gap width of the sealed part is adjusted by varying the thickness of seal layer 19 in the sealing step or by the other method. In Table 1, mark O indicates acceptance, and mark x indicates un-acceptance.

Table 1

As shown in No. 1 through 5, when a glass substrate with a thickness of 1.8 mm is used, the noise evaluation result indicates acceptance when the gap width of the sealed part is 10 μm or more. The crosstalk evaluation result indicates acceptance when the gap width of the sealed part is 70 μm or less. The peripheral strain evaluation result indicates acceptance when the gap width of the sealed part is 50 μm or less.

As shown in No. 6 through 9, a similar result is obtained when a glass substrate with a thickness of 1.2 mm is used.

As shown in No. 10 through 11, in a case where a glass substrate with a thickness of 2.8 mm and a glass substrate with a thickness of 1.8 mm are used in combination, all of the noise evaluation result, the crosstalk evaluation result and the peripheral strain evaluation result indicate acceptance when the gap width of the sealed part is 50 μm.

As shown in No. 12 through 14, also when a conventionally used glass substrate with a thickness of 2.8 mm is employed, the noise evaluation result indicates acceptance when the gap width of the sealed part is zero or more. When the gap width is 10 μm or more, however, the crosstalk evaluation result indicates un-acceptance. Therefore, the range where both the noise evaluation result and crosstalk evaluation result indicate acceptance is extremely narrow.

Figure 5:
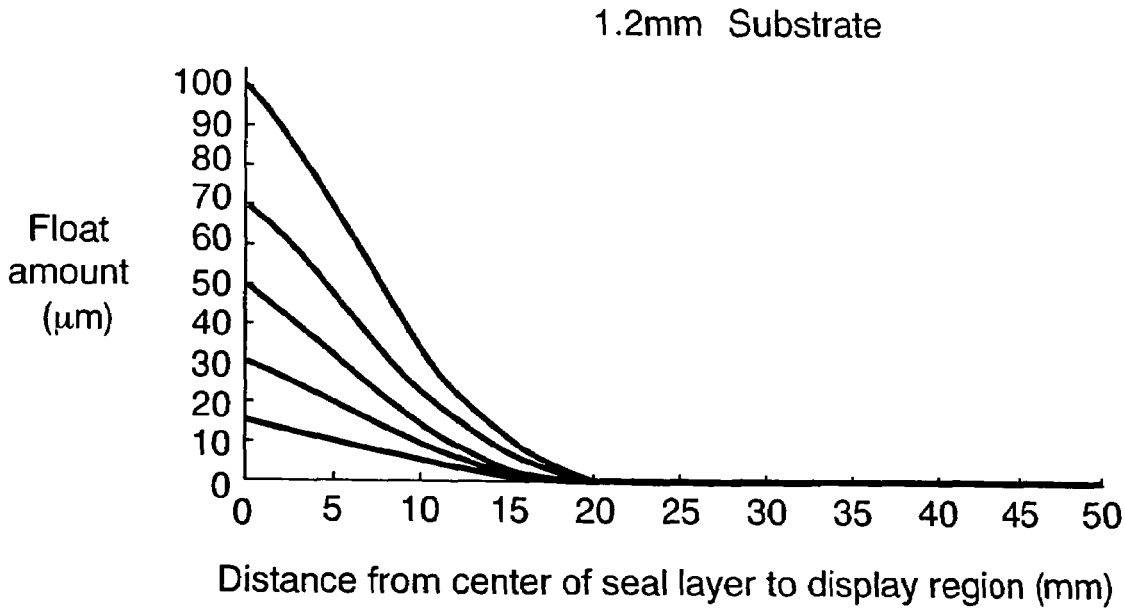
FIG. 5 illustrates variation in the gap width depending on the thickness of the PDP in accordance with the exemplary embodiment.
Figure 6:
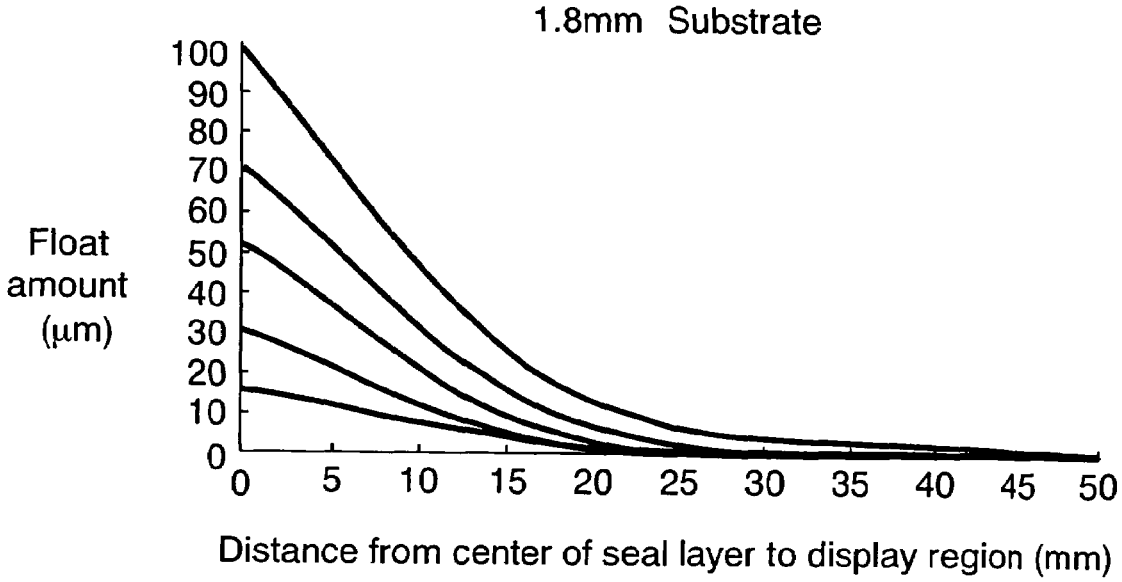
FIG. 6 illustrates variation in the gap width depending on the thickness of the PDP in accordance with the exemplary embodiment.
Figure 7:
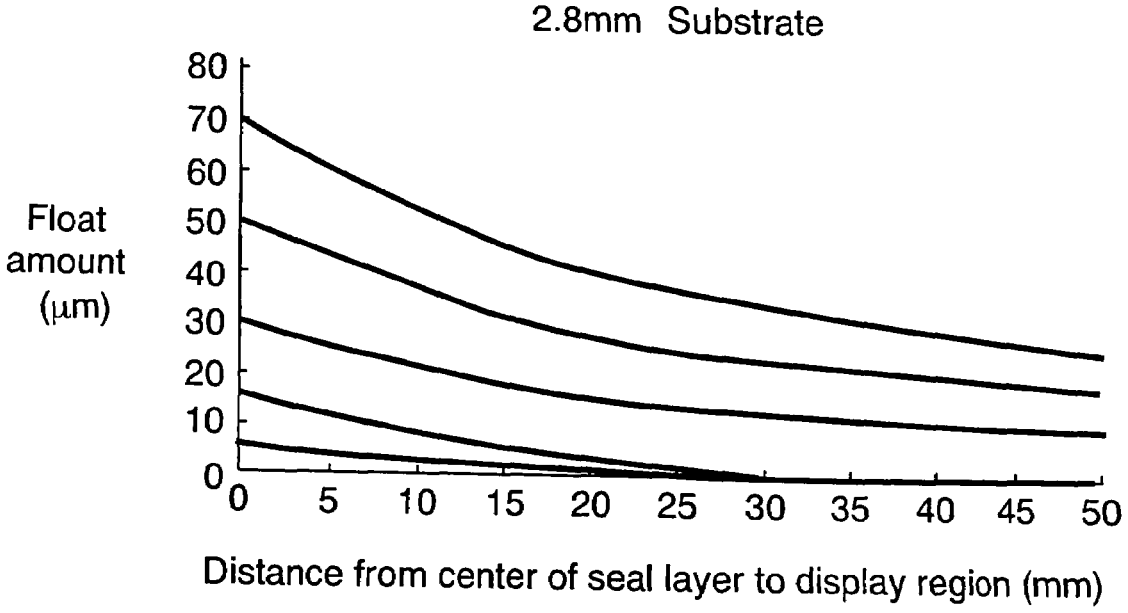
FIG. 7 illustrates variation in the gap width depending on the thickness of the PDP in accordance with the exemplary embodiment.

Such results are considered to significantly depend on the relationship between the thickness of the used glass substrate and the gap width. The gap width is obtained by subtracting thickness Q of the central part of image display region 17 in PDP 1 from thickness X of PDP 1. The gap width in the center of seal layer 19 corresponds to the gap width in the sealed part. FIG. 5 through FIG. 7 illustrate the relationship between the gap width and the distance from the center of seal layer 19 to the center of image display region 17 when the thicknesses of the glass substrates are 1.2 mm, 1.8 mm, and 2.8 mm.

In any thickness, the gap width is the most in the center of seal layer 19, namely in the sealed part, and decreases toward image display region 17.

Occurrence of the crosstalk is closely related to the gap width. In the relationship between the gap width in image display region 17 and the increment of the voltage applied to the address electrodes, when the gap width in the image display region becomes 5 μm or more, the increment of the voltage applied to the address electrodes sharply increases and exceeds 5 V. Thus, preferably, the gap width in the image display region is kept at 5 μm or less.

While, it is preferable that the distance from the center of the sealed part to image display region 17 is minimized considering that the screen size is increased and the cost per inch of image display region 17 is reduced. In a plasma display panel of about 37 to 50 inches, the distance is required to be about 20 to 30 mm in order to form a substrate support part in manufacturing a PDP or a drawing section of an electrode terminal.

Therefore, as shown in FIG. 5, the crosstalk does not occur in image display region 17 of a substrate with a thickness of 1.2 mm. As shown in FIG. 6, the crosstalk does not occur in a substrate with a thickness of 1.8 mm when the camber amount of the substrate is 50 μm or less. As shown in FIG. 7, the crosstalk occurs in a substrate with a thickness of 2.8 mm even when the camber amount of the substrate is 20 μm.

Figure 8:
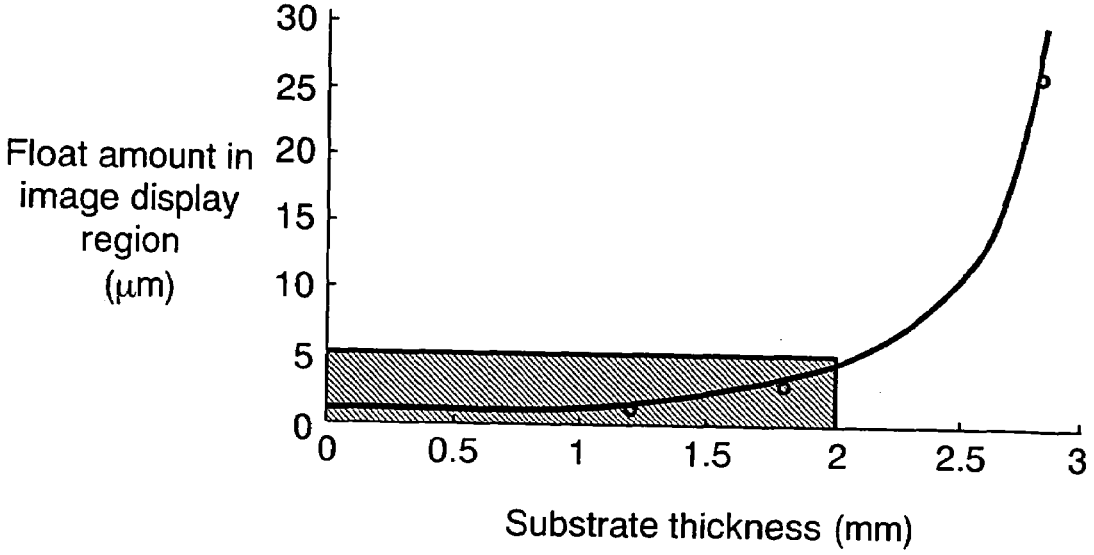
FIG. 8 illustrates the relationship between the gap width and the thickness of the glass plate of the PDP in accordance with the exemplary embodiment.

FIG. 8 illustrates the relationship between the thickness of the substrate of the PDP and the gap width in the image display region. In FIG. 8, the gap width in the sealed part is fixed at 50 μm. The distance of image display region 17 from the center of the sealed part is fixed at 20 mm. Keeping the thickness of the glass substrate to be 2 mm or less can keep the gap width in the image display region to be 5 μm or less. However, when the thickness of the glass substrate is less than 0.5 mm, breakage of the glass substrate disturbs the production of a PDP. Therefore, the thickness of the glass substrate is preferably 0.5 mm or greater. When the thickness of the glass substrate is 2 mm or less and the gap width in the sealed part is 50 μm or less, sufficient lighting can be achieved and noise occurrence at a high altitude can be suppressed while sufficient strength is kept.

A PDP of the present invention can be sufficiently lighted without damaging the strength uniformity, and is effectively used in an image display device with a large screen.

The invention claimed is:

1. A plasma display panel comprising:

an image display region and a non-image display region formed by facing a pair of glass substrates to each other; and a sealed part formed by sealing peripheries of the pair of glass substrates in the non-image display region with a seal layer, wherein a thickness of at least one glass substrate of the pair of glass substrates is at least 0.5 mm and no more than 1.8 mm, wherein an interval between the pair of glass substrates in the sealed part is longer than an interval between the pair of glass substrates in the image display region, and wherein a distance between a center region of the sealed part and the image display region is at least 20 mm and no more than 30 mm.

2. The plasma display panel of claim 1, wherein a difference between (i) the interval between the pair glass substrates in the sealed part, and (ii) the interval between the pair of glass substrates in the image display region, is at least 10 μm and no more than 50 μm.

3. The plasma display panel comprising:

an image display region and a non-image display region formed by facing a pair of glass substrates to each other; and a sealed part formed by sealing peripheries of the pair of glass substrates in the non-image display region with a seal layer, wherein a thickness of at least one glass substrate of the pair of glass substrates is at least 0.5 mm and no more than 1.8 mm, wherein an interval between the pair of glass substrates in the sealed part is longer than an interval between the pair of glass substrates in the image display region, and wherein a difference between (i) the interval between the pair of glass substrates in the sealed part, and (ii) the interval between the pair of glass substrates in the image display region, is at least 10 μm and no more than 50 μm.

* * * * *